405-257 SR
6/9/87 OR 4,671,705

United States Patent [19]
Nussbaumer et al.

[11] Patent Number: 4,671,705
[45] Date of Patent: Jun. 9, 1987

[54] PLUG CONNECTION FOR PLANAR BARRIER WEBS

[75] Inventors: Manfred Nussbaumer, Leonberg; Eberhard Gläser, Aichwald; Eberhard Beitinger, Stuttgart, all of Fed. Rep. of Germany

[73] Assignee: Ed. Züblin Aktiengesellschaft, Stuttgart-Möhringen, Fed. Rep. of Germany

[21] Appl. No.: 784,169

[22] Filed: Oct. 4, 1985

[30] Foreign Application Priority Data

Oct. 6, 1984 [DE] Fed. Rep. of Germany ..... 3436735

[51] Int. Cl.[4] ..... E02D 5/20; E02D 29/00
[52] U.S. Cl. ..... 405/267; 405/258
[58] Field of Search ..... 405/36, 38, 43, 50, 405/51, 71, 109, 267, 270, 274, 278–281

[56] References Cited

U.S. PATENT DOCUMENTS

| | | | |
|---|---|---|---|
| 1,058,077 | 4/1913 | Luce | 405/109 |
| 4,484,835 | 11/1984 | van Klinken | 405/52 |
| 4,519,729 | 5/1985 | Clarke | 405/267 |

FOREIGN PATENT DOCUMENTS

| | | | |
|---|---|---|---|
| 2138123 | 2/1973 | Fed. Rep. of Germany | 405/109 |
| 209010 | 4/1984 | Fed. Rep. of Germany | 405/270 |
| 49424 | 4/1980 | Japan | 405/267 |
| 8300596 | 9/1984 | Netherlands | 405/281 |
| 8403315 | 8/1984 | PCT Int'l Appl. | 405/270 |

*Primary Examiner*—Cornelius J. Husar
*Assistant Examiner*—Nancy J. Stodola
*Attorney, Agent, or Firm*—Kenyon & Kenyon

[57] ABSTRACT

A pair of webs each extending over a large area and disposed in a vertical orientation in a suspension are interconnected by a pair of telescoping tubes attached to juxtaposed edges of the respective barrier webs. Material of the suspension is removed from the space within the inner tube to provide a hydraulic trap for liquid entering the connection or coupling between the two tubes. A device is provided for inspecting the level of the liquid collected in the hydraulic trap or for removing the collected liquid. The barrier webs are advantageously made of synthetic resin material such as high-density polyethylene.

26 Claims, 8 Drawing Figures

PLUG CONNECTION FOR PLANAR BARRIER WEBS

BACKGROUND OF THE INVENTION

The invention relates to a plug connection for planar barrier webs.

Large-area sealing measures in foundation and hydraulic engineering, as well as for encapsulating contaminated locations such as depositories and the like, must comprise, as a rule, sections with finite dimensions if foils, plates or membranes are used. The connection of these sections to each other should be so tight that no appreciable effect on the barrier action occurs at the connecting points. If flat barrier layers of foils, plates or membranes are built-in horizontally, the connection is usually made by welding or cementing at the overlap edges. In contrast, the preparation of vertical barrier layers generally necessitates a production method in which the foils or plates or membranes are placed section by section in a slot filled with suspension. For this method of fabrication, no connection elements are known which assure a reliable and controllable barrier action at the connection point.

It is therefore an object of the invention to provide a device for connecting large-area barrier layers which are positioned section by section in suspension-filled slots, which device is reliably tight and has a sealing action which remains controllable for a long term after fabrication is completed.

SUMMARY OF THE INVENTION

A plug connection according to the present invention comprises telescoping tubes which are rigidly attached to the edges of the respective barrier layer sections to be connected. After the tubes are pushed together, the interior of the plug connection is cleaned out. Possible circulation of liquids in the space between the slotted outer tube of the plug connection and the inner plug-in pipe is interrupted by openings into the interior of the inner pipe so that the cleaned-out interior acts as a "hydraulic trap" for liquids that may have penetrated. By level measurements or drawing-off of the liquids which have entered the interior of the inner pipe, the barrier action of the plug connection can be controlled for a long time after construction is completed.

DETAILED DESCRIPTION

Figure 1:
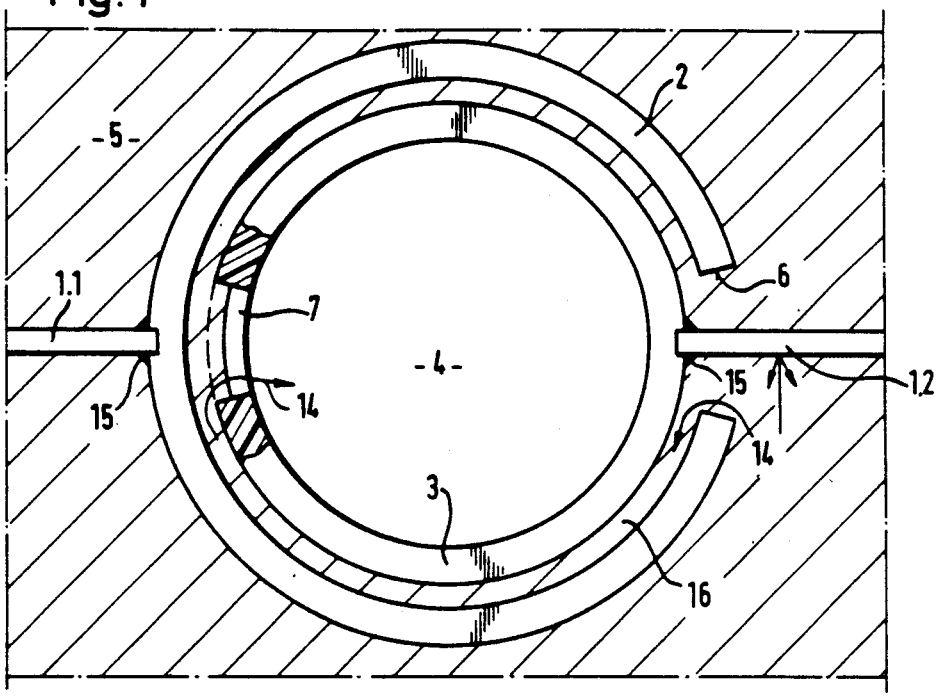
FIG. 1 is a transverse cross section through a plug connection in accordance with the invention.

At juxtaposed edges of a pair of large-area barrier webs in the form of foils, plates or membrane sections 1.1 and 1.2, as shown in FIG. 1, a slotted outer tube 2 and an inner plug-in tube 3 are arranged tightly and continuously one within the other. In the particular embodiment shown here, the edge of barrier web 1.1 is welded to a slot in outer tube 2 and the edge of barrier web 1.2 in the inner plug-in tube 3. These connecting seams 15 can be fabricated, however, without a slot or by cementing. The inside diameter of the slotted outer tube 2 is larger than or equal to the outside diameter of the inner plug-in tube 3. As a rule, the outside diameter of the inner plug-in tube 3 is larger than slot 6 in the slotted outer tube 2, so that a forced guidance of the inner plug-in tube 3 is provided when the inner plug-in tube 3 is inserted into the slotted outer tube 2. Positioning the barrier layer section 1.2 with the inner plug-in tube 3 takes place in the suspension 5 of the slot. A space 16 between the inner plug-in tube 3 and the slotted outer tube 2 and an interior space within inner plug-in tube 3 is filled initially with the material of suspension 5. After a certain degree of initial hardening of the material of suspension 5, interior space 4 is cleaned out. This cleaning out can be accomplished by, for instance, high-pressure water jets and pumping-off. In the inner plug-in tube 3, openings 7 are provided opposite the respective connecting seam 15. If a liquid 14 in suspension 5 penetrates through slot 6 into space 16, this liquid 14 is conducted through openings 7 into interior space 4 and is thereby prevented from further circulation in space 16. The interior space 4 and its openings 7 to space 16 thus act as a "hydraulic trap" for liquids 14 which may have penetrated into space 16.

Figure 2:
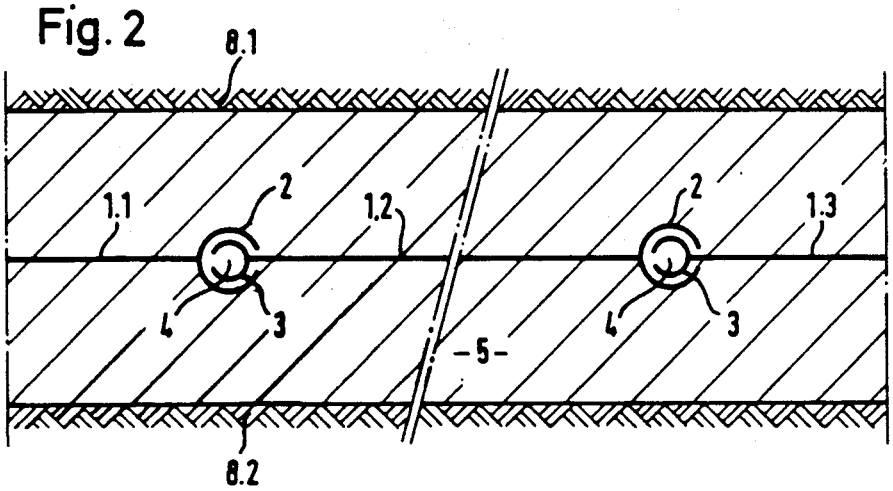
FIG. 2 is a transverse section through a sealing assembly with a plug connection according to the invention.

FIG. 2 shows in schematic cross section a vertical sealing barrier formed of webs 1.1, 1.2 and 1.3. Into a slot filled with suspension 5 and defined by wall boundaries 8.1 and 8.2, barrier webs, foils, plates or membrane sections 1.1, 1.2 and 1.3 are placed. The sections 1.1, 1.2 and 1.3 are connected to one another via plug connections according to the invention. Each plug connection includes slotted outer tube 2 and inner plug tube 3 as well as cleaned-out interior 4.

Figure 3:
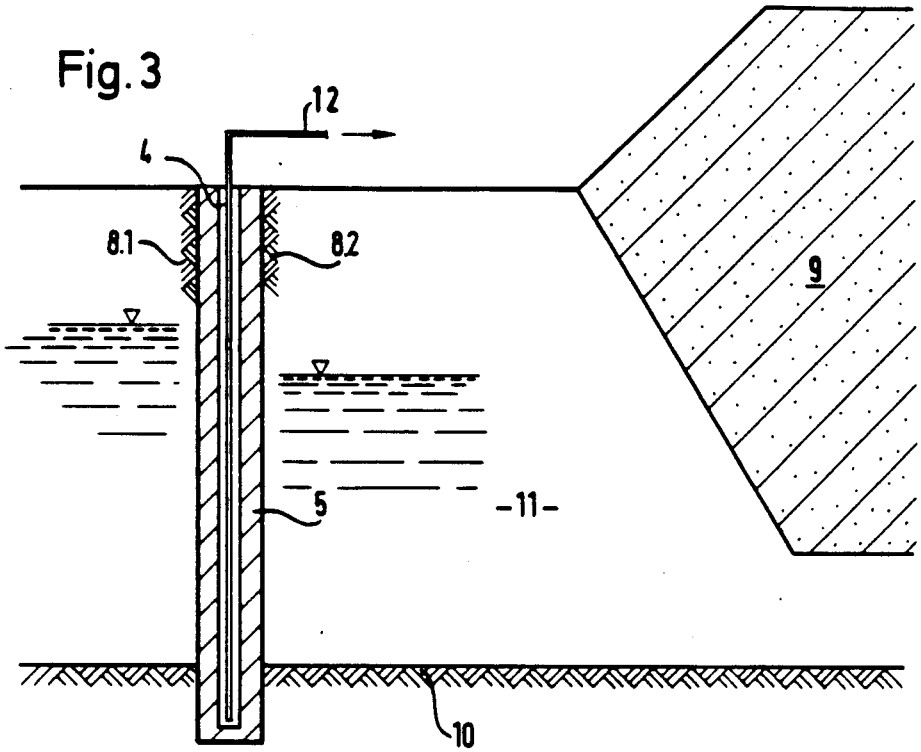
FIG. 3 is a schematic longitudinal section through a sealing assembly at a depository.

To prevent seepage water from a depository body 9 illustrated schematically in FIG. 3 from escaping, a vertical sealing wall is disposed in the vicinity of permeable soil layers 11, which wall leads to an impermeable soil horizon or layer 10. The vertical sealing wall comprises a slot which is defined by boundaries 8.1 and 8.2 and is filled with a hardening suspension 5. A barrier 1 of at least one layer of webs, foils, plates or membranes is disposed in the suspension. In the interior space 4 of the plug connection shown in FIG. 3 is disposed a device 12 for taking off liquid or for leveling out the liquid level in the interior space.

Figure 4:
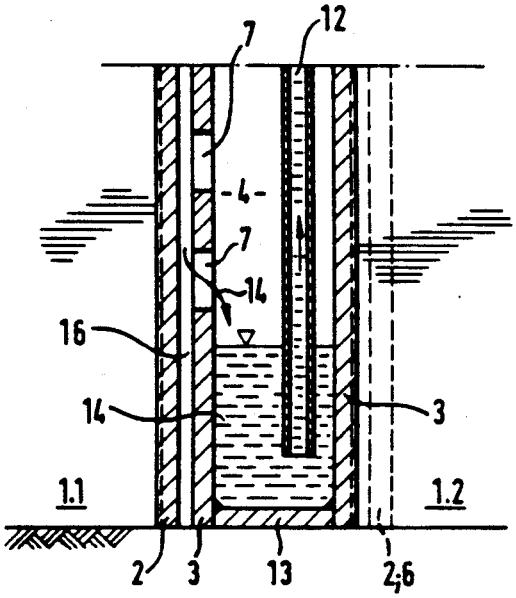
FIG. 4 is a schematic longitudinal section through a plug connection in accordance with the invention.

In an embodiment of the invention shown in FIG. 4, the lower end of the inner plug tube 3 is closed off by a bottom plate 13. Liquid 14 which has penetrated into intertube space 16 is conducted via openings 7 into interior space 4 of inner plug tube 3 and is collected there. The collected liquid 14 can be suctioned off and/or leveled out via a device 12, including a pipe and, for depths greater than 8 m, a pump (not shown). Inner plug tube 3 is surrounded by slotted outer tube 2. To tubes 2 and 3 are attached the respectively adjacent barrier layer sections 1.1 and 1.2.

Figure 5:
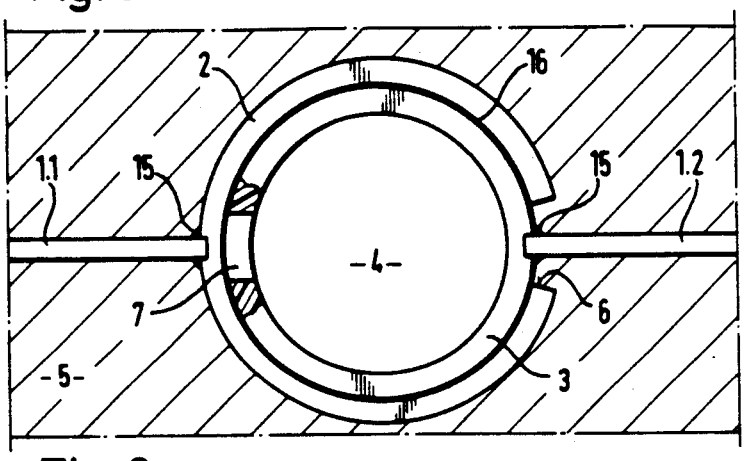
FIG. 5 is a transverse section through another plug connection in accordance with the invention.

In an advantageous embodiment of the invention shown in FIG. 5, the inside diameter of slotted outer tube 2 is equal to the outside diameter of the inner plug tube 3 so that an accurately fitting seat is provided. A first advantage of this design is the direct sealing surface between the inner plug tube 3 and the slotted outer tube 2. A further advantage is the geometrical, unambiguous boundary of interior space 4 when the latter is flushed out, so that no material of suspension 5 can follow through space 16. This makes an evacuation of space 4 possible even if the suspension is not of a hardening type.

Figure 6:
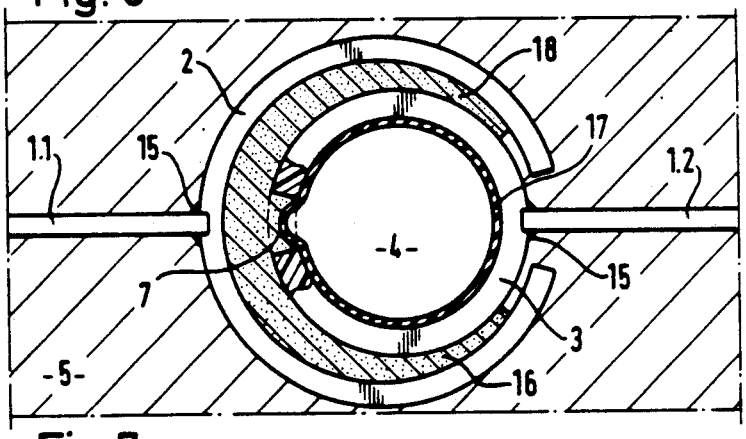
FIG. 6 is a transverse section through another plug connection pursuant to the present invention.

FIG. 6 shows the plug connection comprising inner plug tube 3 and slotted outer tube 2. Before inner plug tube 3 is put in place in outer tube 2, a hose 17 is placed in interior space 4 and is filled with air or advantageously with a liquid, so that interior space 4 is completely filled and no material of suspension 5 can enter. After the connection is made, the hose is emptied and removed and interior space 4 is cleaned out. To enhance the barrier effect, space 16 can additionally be filled under pressure with a suitable sealing compound 18.

Figure 7:
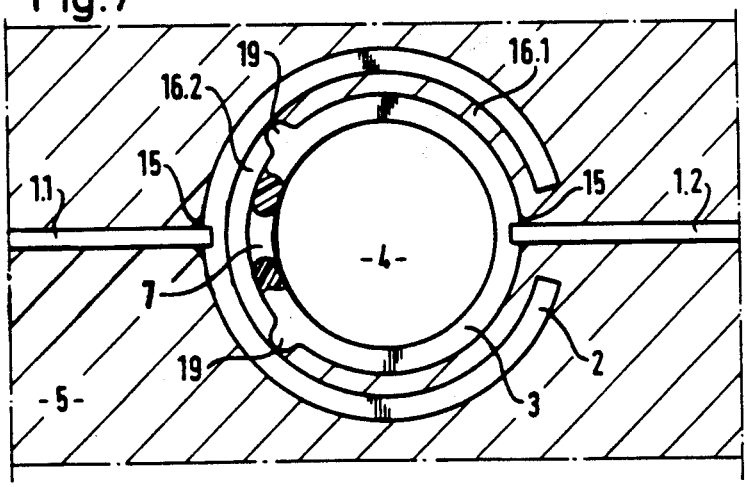
FIG. 7 is a transverse section through a yet another plug connection pursuant to the present invention.

FIG. 7 shows inner plug tube 3 provided with longitudinal beads which engage the inside surface of slotted outer tube 2. These sealing beads 19 have such a height or depth that a certain contact pressure is preserved over the long term. A space 16.1 outside the sealing beads is filled with suspension 5. An inner space 16.2 is flushed out together with interior space 4 and openings 7. If the sealing beads are permeable, liquid 14 which has passed through the beads is collected in interior space 4 and discharged from there in accordance with the invention.

Figure 8:
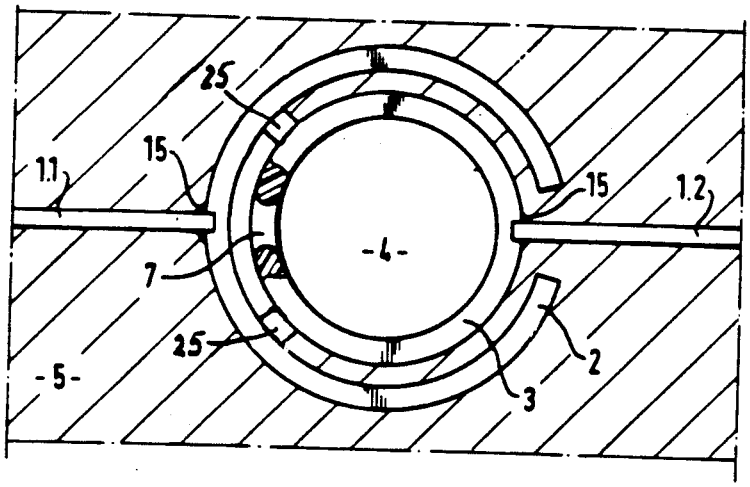
FIG. 8 is a transverse section through a further plug connection in accordance with the invention.

As illustrated in FIG. 8, as an alternative to sealing beads 19, sealing profiles of rubber-elastic materials 25 may be either slipped-in or advantageously fastened, cemented or welded in slots or directly on the surface of inner plug tube 3.

The materials for laminar barrier webs or sections 1.1, 1.2 and 1.3 and the connecting elements are a preferably plastic and advantageously high-density polyethylene (HDPE). The geometric dimensions are variable. In an advantageous design, the following dimensions are conceivable: the thickness of the barrier webs 1.1, 1.2 and 1.3 is 1 to 10 mm; the wall thickness of slotted outer tube 2 and inner plug tube 3 is 5 to 20 mm; the mean diameter of inner plug tube 3 is 50 to 200 mm; the mean diameter of slotted outer tube 2 is 70 to 250 mm; width of slot 6 is 10 to 50 mm and of openings 7 is 6 to 30 mm; and the thickness of space 16 is 0 to 20 mm.

What is claimed is:

1. An assembly for use in forming a barrier in a suspension, said assembly comprising:

a first web extending over a large area and having a first edge;

a first tube connected to said first edge and extending therealong, said first tube having a first diametric dimension;

a second web extending over a large area and having a second edge, said first web and said second web being insertable in a substantially vertical orientation into the suspension;

a second tube connected to said second edge and extending therealong, said second tube having a longitudinal slot and a second diametric dimension larger than said first diametric dimension so that said first tube may be telescoped into said second tube to form a plug connection between said first and said second web; and means provided in said first tube, including at least one aperture therein, for enabling drainage of fluid from a space between said first tube and said second tube into said first tube upon insertion of said first tube into said second tube and upon disposition of said first and said second web in said suspension.

2. An assembly according to claim 1 wherein said first web, said second web, said first tube and said second tube are all made of synthetic resin material.

3. An assembly according to claim 2 wherein said first web, said second web, said first tube and said second tube are all made of high density polyethylene.

4. An assembly according to claim 1 wherein said first tube has an outside diametric dimension and said second tube has an inside diametric dimension, said inside diametric dimension being larger than said outside diametric dimension.

5. An assembly according to claim 1 wherein said first tube has an outside diametric dimension and said second tube has an inside diametric dimension, said inside diametric dimension being approximately equal to said outside diametric dimension.

6. An assembly according to claim 1 wherein said first tube has an outside diametric dimension and said second tube has an inside diametric dimension, said inside diametric dimension being larger than said outside diametric dimension prior to an insertion of said first tube into said second tube.

7. An assembly according to claim 1 wherein said aperture takes the form of a continuous longitudinal slot.

8. An assembly according to claim 1 wherein said aperture takes the form of a drilled or punched hole.

9. An assembly according to claim 1 wherein said first tube is provided at a bottom end with a closure in the form of an end plate.

10. A substantially fluid tight barrier in a suspension, said barrier comprising:

a first web extending over a large area and having a first edge;

a first tube connected to said first edge and extending therealong, said first tube having a first diameter;

a second web extending over a large area and having a second edge, said first web and said second web being disposed in a vertical orientation in the suspension;

a second tube connected to said second edge and extending therealong; said second tube having a longitudinal slot and a second diameter larger than said first diameter, said first tube being telescoped into said second tube to form a plug connection between said first and said second web, said first tube defining a central space substantially free of material of said suspension; and means provided in said first tube, including at least one aperture therein, for enabling drainage of fluid from a space between said first tube and said second tube into said central space.

11. An assembly according to claim 10, further comprising extraction means disposed in said first tube for removing collected liquid therefrom.

12. An assembly according to claim 10, further comprising a hose disposed in said first tube so that an outer surface of said hose engages an inner surface of said first tube substantially along the entire length thereof.

13. An assembly according to claim 12 wherein said hose is filled with a liquid.

14. An assembly according to claim 10 wherein said first tube is provided on an outer surface with at least one longitudinally extending sealing bead tightly engaging an inner surface of said second tube.

15. An assembly according to claim 10 wherein the space between said first tube and said second tube is filled with a sealing compound.

16. An assembly according to claim 10, further comprising a linear sealing profile having an outer edge tightly and continuously engaging an inner surface of said second tube and an inner edge tightly and continuously engaging an outer surface of said first tube.

17. An assembly according to claim 16 wherein said linear sealing profile consists of rubber-elastic material.

18. An assembly according to claim 16 wherein said linear sealing profile is attached to said outer surface by cementing.

19. An assembly according to claim 16 wherein said linear sealing profile is attached to said outer surface by welding.

20. An assembly according to claim 16 wherein said linear sealing profile is attached to said outer surface by insertion of an edge of said linear sealing profile into a slot formed in said first tube.

21. A method for forming a substantially fluid tight barrier in a suspension, comprising the steps of:

providing a first web extending over a large area and having a first edge, a first tube being connected to said first edge and extending therealong, said first tube having a first diametric dimension and an aperture in a longitudinally extending wall;

providing a second web extending over a large area and having a second edge, a second tube being connected to said second edge and extending therealong, said second tube having a longitudinal slot and a second diametric dimension larger than said first diametric dimension;

disposing said first web and said second web in a vertical orientation in the suspension;

substantially simultaneously with said step of disposing, telescoping said first tube into said second tube to form a plug connection between said first and said second web, said first tube surrounding a central space; and cleaning said central space so that it is substantially free of material of said suspension, said aperture and said step of cleaning together serving to enable drainage of fluid from a space between said first tube and said second tube into said central space.

22. A method according to claim 21, further comprising the steps of disposing an extraction device in said first tube and removing, via said extraction device, liquid collected in said first tube.

23. A method according to claim 21, further comprising the steps of (a) disposing a hose in said first tube so that an outer surface of said hose engages an inner surface of said first tube substantially along the entire length thereof and (b) removing said hose from said first tube upon a hardening of material of said suspension in a space between said first tube and said second tube.

24. A method according to claim 23 wherein said hose is filled with a liquid prior to said step of removing.

25. A method according to claim 21, further comprising the step of filling the space between said first tube and said second tube with a sealing compound.

26. A method for forming a substantially fluid tight barrier in a suspension, comprising the steps of:

providing a first web extending over a large area and having a first edge, a first tube being connected to said first edge and extending therealong, said first tube having a first diametric dimension;

providing a second web extending over a large area and having a second edge, a second tube being connected to said second edge and extending therealong, said second tube having a longitudinal slot and a second diametric dimension larger than said first diametric dimension;

disposing said first web and said second web in a vertical orientation in the suspension;

substantially simultaneously with said step of disposing, telescoping said first tube into said second tube to form a plug connection between said first and said second web, said first tube surrounding a central space;

cleaning said central space so that it is substantially free of material of said suspension, means being provided in said first tube, including at least one aperture therein, for enabling drainage of fluid from a space between said first tube and said second tube into said central space; and draining fluid from said space between said first tube and said second tube into said central space.

* * * * *